US008245678B2

(12) United States Patent
Watanabe

(10) Patent No.: US 8,245,678 B2
(45) Date of Patent: Aug. 21, 2012

(54) VARIABLE VALVE TIMING CONTROL APPARATUS OF INTERNAL COMBUSTION ENGINE

(75) Inventor: Masahiko Watanabe, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 736 days.

(21) Appl. No.: 12/470,755

(22) Filed: May 22, 2009

(65) Prior Publication Data

US 2009/0301416 A1 Dec. 10, 2009

(30) Foreign Application Priority Data

Jun. 9, 2008 (JP) ..... 2008-150017

(51) Int. Cl.
*F01L 1/34* (2006.01)

(52) U.S. Cl. ..... 123/90.17; 123/90.15

(58) Field of Classification Search .... 123/90.15–90.17, 123/90.12, 90.33
See application file for complete search history.

(56) References Cited

U.S. PATENT DOCUMENTS

| | | | | |
|---|---|---|---|---|
| 3,978,829 | A | 9/1976 | Takahashi et al. | |
| 6,948,464 | B2 * | 9/2005 | Ido et al. | 123/90.15 |
| 7,278,386 | B2 * | 10/2007 | Hori et al. | 123/90.17 |
| 7,624,710 | B2 | 12/2009 | Uehama et al. | |
| 2007/0295294 | A1 * | 12/2007 | Morii et al. | 123/90.17 |

FOREIGN PATENT DOCUMENTS

| | | | |
|---|---|---|---|
| JP | 50-155822 | A | 12/1975 |
| JP | 60-149808 | U | 10/1985 |
| JP | 4-228813 | A | 8/1992 |
| JP | 11-141314 | A | 5/1999 |
| JP | 11-190417 | A | 7/1999 |
| JP | 2005-113754 | A | 4/2005 |
| JP | 2005-337010 | A | 12/2005 |
| JP | 2007-120327 | A | 5/2007 |
| JP | 2008-95549 | A | 4/2008 |

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

A variable valve timing control apparatus of an internal combustion engine has a drive rotary member, a driven rotary member, and an electric motor which rotates with the drive rotary member and changes a rotational phase of the driven rotary member relative to the drive rotary member through a current application to a coil. The electric motor is covered with a cover member with a clearance interposed therebetween, and a bearing member is installed between an outer periphery of the electric motor and an inner periphery of the cover member for rotatably supporting the electric motor. The bearing member defines a space portion between an end surface, in a rotation shaft direction, of the electric motor and an opposing inner end surface of the cover member, and the space portion is supplied with lubricating oil by a lubricating oil supplying mechanism.

22 Claims, 7 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which is a variable valve system that variably controls open/close timing of an intake valve and/or an exhaust valve of the engine through a phase control mechanism by an electric motor.

In recent years, there have been proposed and developed various variable valve systems, which variably control valve open and closure timings and a valve lift amount of engine intake/exhaust valves in accordance with an engine operating state. One such variable valve system has been disclosed in Japanese Patent Provisional Publication No. 11-141314 (hereinafter is referred to as "JP11-141314").

In JP11-141314, a variable valve system has both a variable valve timing mechanism and a variable valve lift mechanism, and a stator of an electric motor is linked to a timing pulley whose rotation is driven by an engine crankshaft, and a rotor of the electric motor is connected with a camshaft through a change mechanism. This camshaft is provided with a driving cam whose outer circumferential surface is tapered.

When a control unit (ECU) applies power to a coil of the electric motor, a motor shaft rotates, then the camshaft rotates relative to the timing pulley through the change mechanism, also the camshaft moves in an axial direction. With this mechanism, for instance, both of the valve timing and the valve lift amount of the engine intake valve are variably controlled in accordance with the engine operating state.

SUMMARY OF THE INVENTION

In the variable valve system in JP11-141314, however, although the electric motor is rotatably supported by a belt cover member provided on a front end side of the engine through a bearing member, lubricity of this bearing member is not taken into consideration at all. Because of this, there is a possibility that the lubricity of the bearing member will decrease.

It is therefore an object of the present invention to provide a variable valve system which is capable of solving technical problems of the conventional variable valve system.

According to one aspect of the present invention, a variable valve timing control apparatus of an internal combustion engine, comprises: a drive rotary member adapted to be driven in synchronization with rotation of an engine crankshaft; a driven rotary member which rotates and actuates an engine valve by a turning force transmitted from the drive rotary member; an electric motor which rotates with the drive rotary member and changes a rotational phase of the driven rotary member relative to the drive rotary member through a current application to a coil; a cover member which covers the electric motor with a clearance interposed therebetween; a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member; and a lubricating oil supplying mechanism which supplies lubricating oil to the space portion.

According to another aspect of the present invention, a variable valve timing control apparatus of an internal combustion engine, comprises: a drive rotary member adapted to be driven in synchronization with rotation of an engine crankshaft; a driven rotary member which rotates and actuates an engine valve by a turning force transmitted from the drive rotary member; an electric motor which rotates with the drive rotary member and changes a rotational phase of the driven rotary member relative to the drive rotary member through a current application to a coil; a cover member which covers the electric motor with a clearance interposed therebetween; a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member; and a communication passage which is formed on an inner surface of the cover member and connects an inside of the cover member and the space portion while straddling the bearing member, and by which lubricating oil that adheres to the inner surface of the cover member passes through the bearing member and is supplied to the space portion.

According to a further aspect of the invention, a variable valve timing control apparatus of an internal combustion engine, comprises: a drive rotary member adapted to be driven in synchronization with rotation of an engine crankshaft; a driven rotary member which rotates and actuates an engine valve by a turning force transmitted from the drive rotary member; an electric motor which rotates with the drive rotary member and changes a rotational phase of the driven rotary member relative to the drive rotary member through a current application to a coil; a cover member which covers the electric motor with a clearance interposed therebetween; a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member, and lubricating oil is supplied to the space portion from an inner circumferential side, which is a rotation shaft side of the electric motor, toward an outer circumferential side.

In the present invention, the lubricating oil supplied inside the space by the lubricating oil supplying means (mechanism) moves or circulates to an outer periphery side of the electric motor by rotational centrifugal force etc. of the electric motor, and then is forcibly supplied to the bearing member. With this, it is possible to lubricate this bearing member well all the time.

The other objects and features of this invention will become understood from the following description with reference to the accompanying drawings.

DETAILED DESCRIPTION OF THE INVENTION

Embodiments of a variable valve timing control apparatus for an internal combustion engine will be explained below with reference to the drawings. Each embodiment below is applied to a variable valve system for an intake valve side of the internal combustion engine, however it can also be applied to the variable valve system for an exhaust valve side.

First Embodiment

Figure 1:
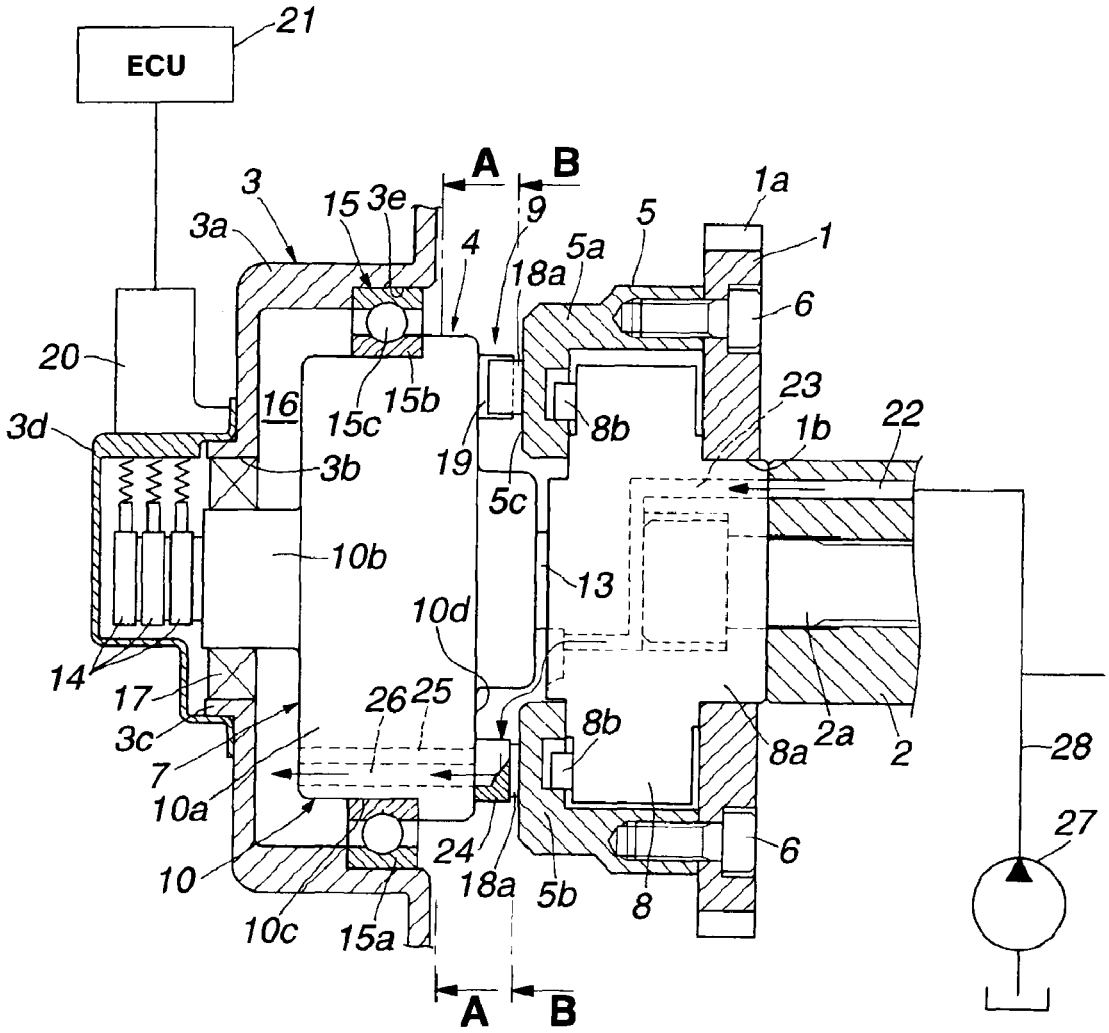
FIG. 1 is a longitudinal cross section of a variable valve timing control apparatus according to a first embodiment of the present invention.
Figure 2:
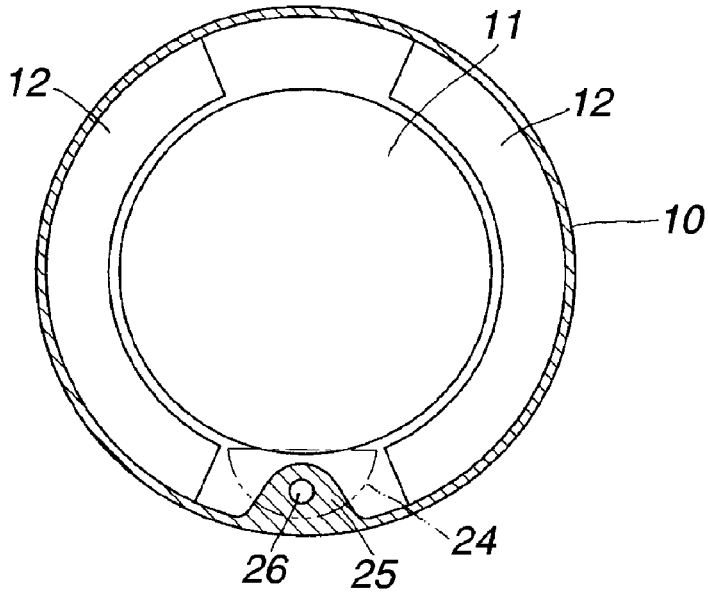
FIG. 2 is a sectional view, viewed from A-A of FIG. 1.

As shown in FIGS. 1 and 2, a variable valve timing control apparatus (VTC) has a timing sprocket 1 as a drive rotary member or driving member which is driven by an engine crankshaft, a camshaft 2 as a driven rotary member or driven member which is rotatably supported on a cylinder head (not shown) of the engine through a bearing (not shown) and rotates by a rotation driving force or turning force transmitted from the timing sprocket 1, a cover member 3 which is disposed on a front side of the timing sprocket 1 and the camshaft 2 and fixed to a cylinder block etc. with a bolt, and a phase-change mechanism or phase converter 4 which is positioned between the timing sprocket 1 and the camshaft 2 and changes or controls a relative rotational phase between timing sprocket 1 and the camshaft 2 in accordance with an engine operating state.

The timing sprocket 1 has a shape of ring-shaped disk, and has a plurality of ring-shaped gear teeth or sprocket teeth 1*a* at its outer circumference. These ring-shaped gear teeth 1*a* are integrally formed with the outer circumference of the timing sprocket 1 in the circumferential direction, and are linked to the engine crankshaft via a timing chain (not shown). Furthermore, the timing sprocket 1 is provided with a circular hole 1*b* at a center thereof for receiving therethrough a connecting part 8*a* of a speed reduction mechanism or speed reducer 8 (both, described later) of the phase-change mechanism 4. The timing sprocket 1 is therefore rotatably supported by the outer peripheral surface of the speed reduction mechanism 8.

In addition, a substantially cylindrical rotation transmission member 5 is secured to a front end surface of the timing sprocket 1 with a plurality of bolts. As seen in FIG. 1, the rotation transmission member 5 protrudes from the front end surface of the timing sprocket 1 in a front direction, and covers or surrounds the speed reduction mechanism 8. This rotation transmission member 5 has a base end part 5*a* and a flange part 5*b* that bends inwards from a top edge of the base end part 5*a*.

The camshaft 2 has two driving cams per cylinder, each of which is secured on an outer peripheral surface of the camshaft 2 and actuates an intake valve (not shown). Further, the connecting part 8*a*, which is one part of the speed reduction mechanism 8, is connected with a front end of the camshaft 2 with a cam bolt 2*a*.

As for the cover member 3, it is a cover member that covers the timing chain etc. The cover member 3 has a cup-shaped swelling or protruding part 3*a* formed on a front end side of the phase-change mechanism 4 and a circular opening part 3*b* formed on the bottom center of the swelling part 3*a*. More specifically, the opening part 3*b* is formed by a cylindrical part 3*c*, and a bottomed cylindrical cap 3*d* is fitted onto the cylindrical part 3*c* then fixed to an outer peripheral surface of the cylindrical part 3*c*.

The phase-change mechanism 4 mainly has an electric motor 7 which is disposed on the front end side of the camshaft 2 and substantially coaxially aligned with the camshaft 2, the speed reduction mechanism 8 which reduces a rotation speed of the electric motor 7 and transmits it to the camshaft 2, and a coupling mechanism 9 which transmits the turning force of the timing sprocket 1 to the electric motor 7 via the rotation transmission member 5.

The electric motor 7 is a brush DC motor, and as shown in FIGS. 1 and 2, this electric motor 7 mainly has a substantially cylindrical housing 10 whose front and rear portions are closed, a rotor 11 which is rotatably installed inside the housing 10 and around which a coil is wound, a pair of semi-arc permanent magnets 12, 12 which are secured on an inner peripheral surface of the housing 10, a motor shaft 13 which is provided in an inner axial direction of the rotor 11 and is a rotation shaft that is connected with the speed reduction mechanism 8, and three slip rings 14 which are installed inside the cap 3*d* and make sliding contact with the brush provided at a rear end of the motor shaft 13.

The housing 10 has a cylindrical housing body 10*a*, both sides of which are closed with end walls, and a small-diameter cylindrical protruding portion 10*b* that protrudes from a substantially center of the end wall on the front end side of the housing body 10*a*. This housing 10 is rotatably supported by the swelling part 3*a* through a ball bearing 15 that is provided as a bearing member between an outer peripheral surface of the housing body 10*a* and an inner peripheral surface of the swelling part 3*a*.

With respect to the ball bearing 15, an outer race 15*a* is fitted into a stepped recessed fitting groove 3*e* that is formed on the inner peripheral surface of the swelling part 3*a*, then positioning of the ball bearing 15 in a radial direction and one side of an axial direction is made. On the other hand, an inner race 15*b* is fitted into a stepped recessed fitting groove 10*c* that is formed on the outer peripheral surface of the housing body 10*a*, then positioning of the ball bearing 15 in the radial direction and the other side of the axial direction is made.

As can be seen in FIG. 1, between the housing 10 and the swelling part 3*a* of the cover member 3, a substantially ring-shaped space portion 16 is provided. An outer circumferential part of this space portion 16 communicates with the ball bearing 15.

In addition, between an outer peripheral surface of the protruding portion 10*b* of the housing 10 and an inner peripheral surface of the cylindrical part 3*c* of the cover member 3, a ring-shaped seal member 17 is provided to seal a gap between the space portion 16 and the cap 3*d*.

Each of the slip rings 14 is connected to an electrical control unit (ECU) 21 through a connector 20. Two of these slip rings 14 are used for applying power to the coil of the electric motor 7, and the remaining one slip ring 14 is used as a detecting sensor for detecting a rotational angle of the electric motor 7. The ECU 21 is configured to detect a current engine operating condition or state on the basis of information signals from sensors such as a crank angle sensor, an airflow meter, an engine temperature sensor and an accelerator opening sensor (all, not shown) then execute an engine control, and also to carry out a rotation control of the motor shaft 13 through the application of power to the coil of the rotor 11 then control the rotational phase (relative rotational angle position) of the camshaft 2 relative to the timing sprocket 1 through the speed reduction mechanism 8.

In the present embodiment, the speed reduction mechanism 8 is formed, for example, by a cycloidal gear speed reducer. However, the speed reduction mechanism 8 could be formed by a planetary gear speed reducer etc. As mentioned above, the connecting part 8*a* is connected with the one end of the camshaft 2 with the cam bolt 2*a* in an axial direction. Further, a part opposite to and separated from the connecting part 8*a* is connected with the rotation transmission member 5 through a plurality of protruding parts 8*b*. The turning force of the timing sprocket 1 is then transmitted to the camshaft 2 from the rotation transmission member 5.

Figure 3:
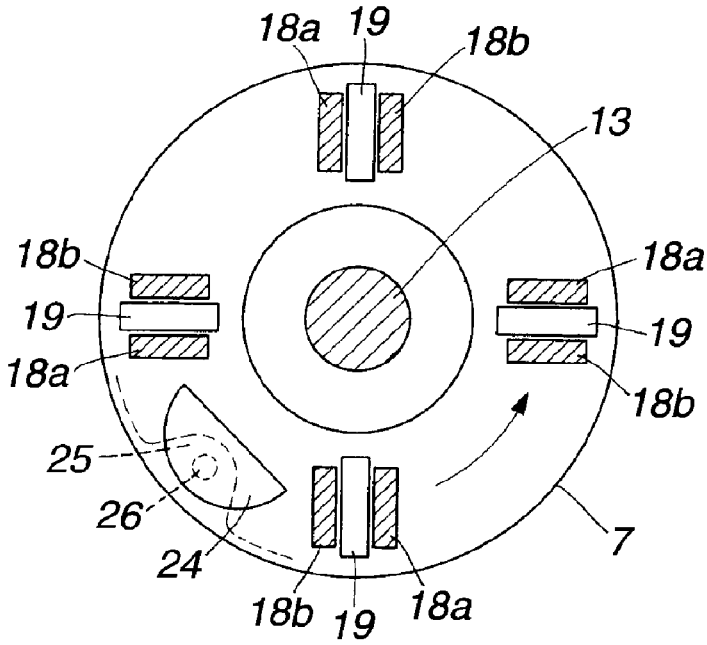
FIG. 3 is a sectional view, viewed from B-B of FIG. 1.

With regard to the coupling mechanism 9, as shown in FIGS. 1 and 3, it is formed from a pair of fitting pieces (protruding portions) 18*a*, 18*b* and fitting protrusions (protruding portions) 19. The fitting pieces 18*a*, 18*b* are protruding rectangular plates that are integrally formed with a front end surface 5*c* of the flange part 5*b* of the rotation transmission member 5, and these fitting pieces 18*a*, 18*b* are provided at almost four 90-degree positions in a circumferential direction of the front end surface 5*c*. On the other hand, the fitting protrusions 19 are four protruding rectangular plates that are integrally formed with a rear end surface 10*d* of the housing 10, which faces the front end surface 5*c* of the flange part 5*b*. The fitting protrusions 19 are located at almost four 90-degree positions so that each fitting protrusion 19 is fitted or inserted between the fitting pieces 18*a* and 18*b*. With this structure, the turning force in one direction (an arrow direction in FIG. 3) transmitted from the rotation transmission member 5 is transmitted to the housing 10 through the fitting pieces 18*a*, 18*b* and the fitting protrusions 19.

As can be seen in FIG. 3, each of the fitting pieces 18*a*, 18*b* extends in a substantially radial direction from a shaft center of the rotation transmission member 5. Each fitting protrusion 19 also extends in a substantially radial direction from a center of the end surface of the housing 10.

Also as is clear from FIG. 3, slight clearances are formed between fitting pieces 18*a*, 18*b* and the fitting protrusion 19 (i.e. on both sides of the fitting protrusion 19). These clearances are provided for accepting a slight shift of axial centers of the housing 10 and the rotation transmission member 5 when these housing 10 and rotation transmission member 5 are installed so that each of them can slightly shift in the radial direction.

Here, in the present invention, lubricating oil is supplied to the space portion 16 by a lubricating oil supplying means (mechanism).

The lubricating oil supplying mechanism is formed from an oil supply hole 22 that is formed inside the camshaft 2 in the axial direction, an oil passage 23 which is formed and bends inside the speed reduction mechanism 8 and whose one end is connected with the oil supply hole 22, an oil receiving portion 24 which is provided on an outer peripheral side of the rear end surface 10*d* of the housing 10 and receives the lubricating oil coming from the other end of the oil passage 23, and an oil leading hole 26 which penetrates a passage forming portion 25 that is integrally formed with an outer peripheral side of an inside of the housing 10 along the axial direction. The oil leading hole 26 leads and supplies the lubricating oil which the oil receiving portion 24 receives to an inside of the space portion 16.

The oil supply hole 22 is connected to a main oil gallery 28 that supplies the lubricating oil to each parts in the engine from an oil pump 27.

Next, working or operation of the present embodiment will be explained in detail. When the crankshaft rotates after an engine start and the timing sprocket 1 rotates via the timing chain, the rotation transmission member 5 also rotates at the same time. While this turning force of the rotation transmission member 5 is being transmitted to the housing 10 of the electric motor 7 from the fitting pieces 18*a*, 18*b* and the fitting protrusions 19 of the coupling mechanism 9, the turning force of the rotation transmission member 5 is also transmitted to the camshaft 2 through the speed reduction mechanism 8 via the protruding parts 8*b*.

On the other hand, under a certain engine operating state after the engine start, the ECU 21 outputs current to the coil of the rotor 11 of the electric motor 7 through the slip rings 14. With this current application, the rotor 11 rotates and the motor shaft 13 is rotated, then this turning force of the motor shaft 13 is transmitted to the camshaft 2 through the speed reduction mechanism 8 as a speed-reduced turning force. By this working, the camshaft 2 rotates toward an advanced angle side or a retarded angle side relative to the timing sprocket 1, then the rotational phase of the camshaft 2 is changed.

As shown by arrows in FIG. 1, the lubricating oil supplied to the oil supply hole 22 through the main oil gallery 28 from the oil pump 27 is collected at the oil receiving portion 24 through an inside of the speed reduction mechanism 8, i.e. through the oil passage 23, and further is supplied to the inside of the space portion 16 through the oil leading hole 26.

This lubricating oil supplied to the inside of the space portion 16 is scattered in the space portion 16 by a rotational centrifugal force of the housing 10, and also flows or circulates to the outer periphery side of the housing 10, then is forcibly supplied to an inside of the ball bearing 15.

Hence, a front end surface of the housing 10 on a side of the slip rings 14 can be effectively cooled down. Additionally, each ball 15*c* of the ball bearing 15 and the outer and inner races 15*a*, 15*b* are adequately lubricated and lubricity can be improved. As a consequence, it is possible to prevent a decrease in performance, due to heat generation in the electric motor 7. Furthermore, the housing 10 can rotate smoothly all the time, and this brings an increase in durability.

In addition, the lubricating oil flowing out to a side of the oil receiving portion 24 through the oil passage 23 beats the fitting pieces 18*a*, 18*b* etc. and is stirred or scattered together with air by the rotations of the rotation transmission member 5 and the housing 10. With this, a side of the rear end surface 10*d* of the housing 10 can also be effectively cooled down.

Moreover, since the gap between the space portion 16 and an installation space where the slip rings 14 are installed is sealed by the seal member 17, the lubricating oil in the space portion 16 does not flow into the installation space and does not adhere to the slip rings 14.

Second Embodiment

Figure 4:
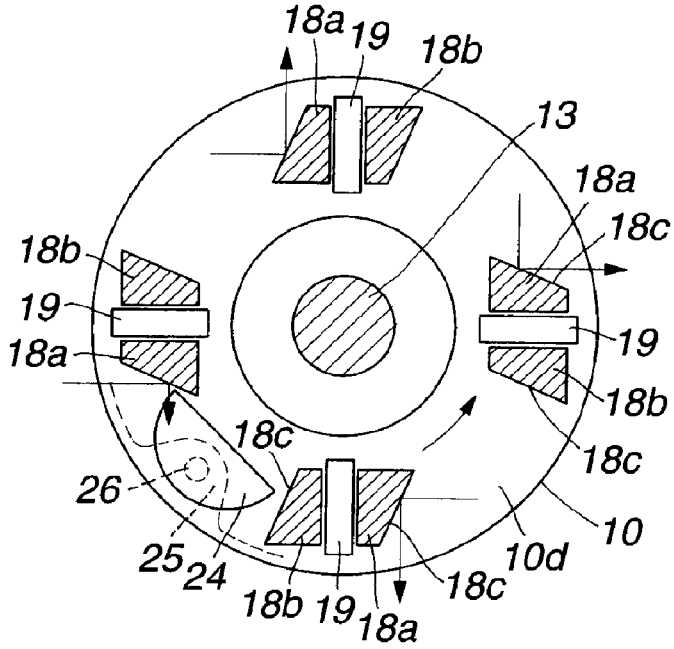
FIG. 4 is a sectional view, viewed from B-B of FIG. 1, showing a coupling mechanism according to a second embodiment.

FIG. 4 shows a coupling mechanism 9 according to a second embodiment. Structure of the four fitting protrusions 19 on the housing 10 side of the electric motor 7 is the same as that of the first embodiment. However, each structure of the fitting pieces 18*a*, 18*b* on the flange part 5*b* side of the rotation transmission member 5 is changed in this embodiment.

That is to say, as can be seen in FIG. 4, the fitting pieces 18*a*, 18*b* are formed so that each of the fitting pieces 18*a*, 18*b* has an outer side surface 18*c* that inclines to a delay side with respect to a normal in a rotation direction.

Thus the lubricating oil flowing out to the oil receiving portion 24 side through the oil passage 23 from oil supply hole 22 beats the outer side surfaces 18*c*, 18*c* by the rotation of the rotation transmission member 5 and is scattered in an arrow direction. Accordingly, the stir effect of the lubricating oil and the air becomes even larger, and this helps the cool-down effect of the rear end surface 10*d* side of the housing 10.

Third Embodiment

Figure 5:
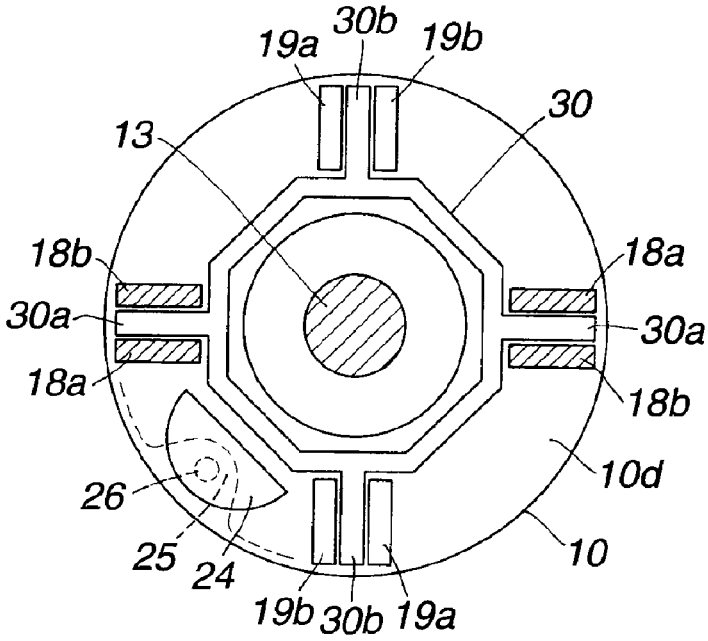
FIG. 5 is a sectional view, viewed from B-B of FIG. 1, showing a coupling mechanism according to a third embodiment.

FIG. 5 shows a coupling mechanism 9 according to a third embodiment. The coupling mechanism 9 is formed as the so-called Oldham coupling.

That is, as can be seen in FIG. 5, a pair of fitting pieces 18*a*, 18*b* are provided at almost two 180-degree positions in the circumferential direction of the front end surface 5*c* of the flange part 5*b*. On the other hand, a pair of fitting protrusions 19*a*, 19*b* are provided on the rear end surface 10*d* of the housing 10 at almost two 180-degree positions which are normal to the positions of the pair of fitting pieces 18*a*, 18*b*. That is to say, a line connecting the two pair of fitting pieces 18*a*, 18*b* and a line connecting the two pair of fitting protrusions 19*a*, 19*b* cross each other at almost right angles.

Further, an octagonal ring-shaped intermediate member 30 is inserted between the front end surface 5*c* of the flange part 5*b* and the rear end surface 10*d* of the housing 10. This intermediate member 30 has four arm portions 30*a*, 30*a*, 30*b*, 30*b* which are integrally formed with the intermediate member 30. The arm portions 30*a*, 30*a* are opposite to each other, likewise, the arm portions 30*b*, 30*b* are opposite to each other. Furthermore, these four arm portions 30*a*, 30*a*, 30*b*, 30*b* protrude from the outer surface so as to be fitted or inserted between the fitting pieces 18*a* and 18*b* and between the fitting protrusions 19*a* and 19*b*. More specifically, the four arm portions 30*a*, 30*a*, 30*b*, 30*b* are fitted or inserted between the fitting pieces 18*a* and 18*b* and between the fitting protrusions 19*a* and 19*b* from radial direction with a slight clearance provided respectively.

Consequently, according to this embodiment, even when the shift or misalignment of the axial centers of the rotation transmission member 5 and the electric motor 7 is large, the intermediate member 30 moves or shifts in the radial direction in accordance with its shift amount (amount of misalignment) and effectively absorbs the shift of the axial centers. Adverse effects caused by the shift of the axial centers, resulting from each assembling or installation error or manufacturing error, can be therefore prevented. As a result, because no sophisticated manufacturing or assembling is required, these workability can be improved.

Fourth Embodiment

Figure 6:
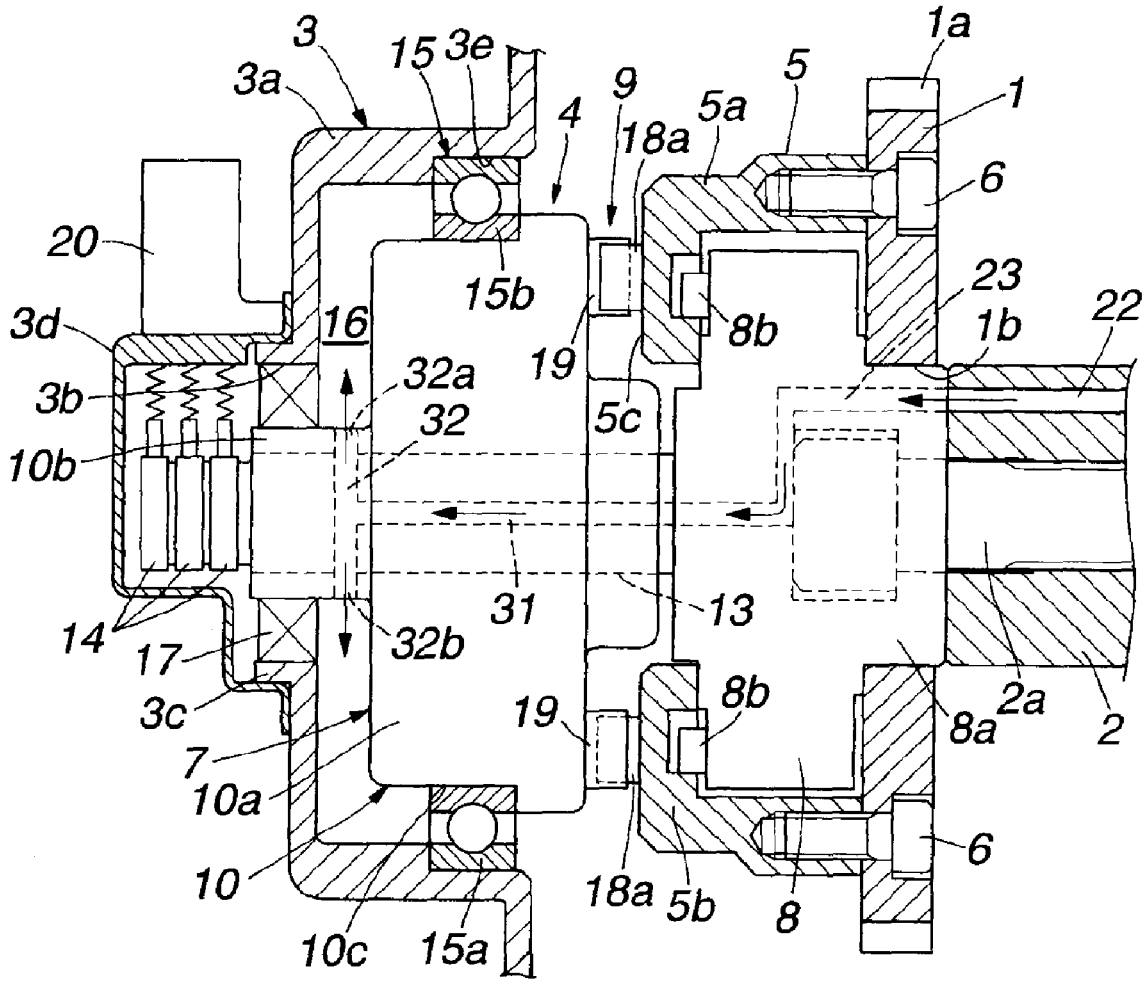
FIG. 6 is a longitudinal cross section of a variable valve timing control apparatus according to a fourth embodiment.

FIG. 6 shows a fourth embodiment. A basic structure of the coupling mechanism 9 etc. is the same as that of the first embodiment. However, an oil passage structure of the lubricating oil supplying mechanism is changed. In this embodiment, an oil passage hole 31 that communicates with the oil passage 23 is formed inside the motor shaft 13 of the electric motor 7 along a shaft center direction. Further, an oil hole 32 that is connected with a downstream end of the oil passage hole 31 is formed inside the motor shaft 13 and inside the protruding portion 10*b* of the housing 10. This oil hole 32 penetrates the protruding portion 10*b* along the radial direction, and its both outer side opening ends 32*a*, 32*b* communicate with the inside of the space portion 16.

In this embodiment, the oil receiving portion 24 and the oil leading hole 26 etc. are not formed.

Consequently, according to this embodiment, the lubricating oil flowing into the oil passage 23 from the oil supply hole 22 flows into the oil passage hole 31 and is supplied to the inside of the space portion 16 via the oil hole 32. Furthermore, the lubricating oil flows or moves to the outer circumferential side of the space portion 16 by the rotational centrifugal force etc. of the electric motor 7, and effectively cools down the electric motor 7. In addition, the ball bearing 15 is also lubricated by this lubricating oil. In particular, the lubricating oil flowing out from the oil hole 32 flows or moves from an inner circumferential side to an outer circumferential side of the front end surface of the housing 10 of the electric motor 7 via the outer side opening ends 32*a*, 32*b*. Thus the cool-down effect of the housing 10 is further improved.

Fifth Embodiment

Figure 7:
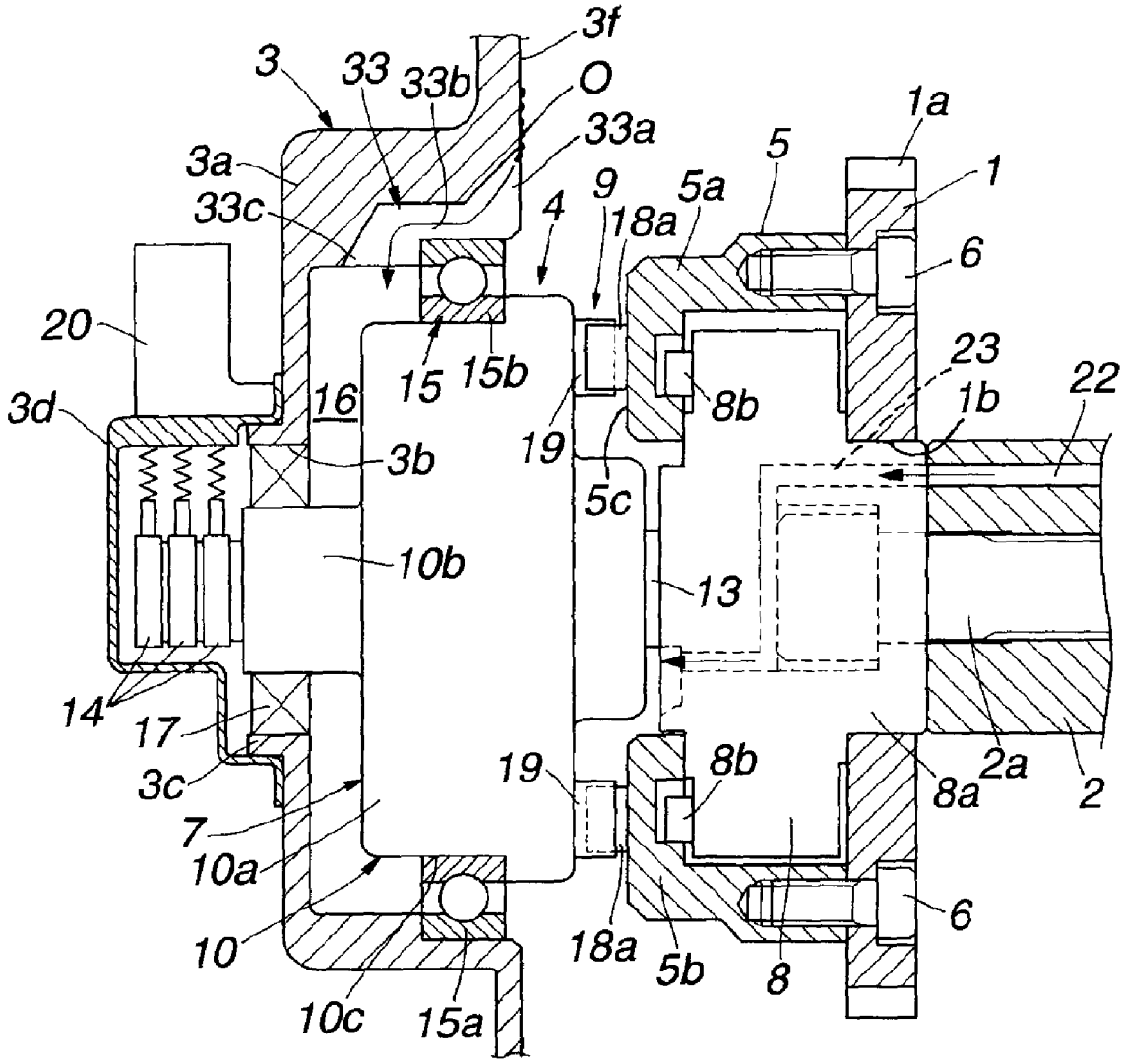
FIG. 7 is a longitudinal cross section of a variable valve timing control apparatus according to a fifth embodiment.

FIG. 7 shows a fifth embodiment. Also in this embodiment, the oil passage structure of the lubricating oil supplying mechanism is further changed. Although the oil supply hole 22 and the oil passage 23 are formed same as the first embodiment, an upper portion of the swelling part 3*a* of the cover member 3 is formed thick, and an oil passage groove 33, which is a communication passage, is formed on an inner surface of this upper portion by cutting-away.

This oil passage groove 33 is bent or cranked from an upper side in the gravity direction, and a sloped upper end portion 33*a* is formed so that the upper end portion 33*a* faces to an inner surface 3*f* of the cover member 3. Further, an almost horizontal middle portion 33*b* is formed so that the middle portion 33*b* straddles an outer surface of the outer race 15*a* of the ball bearing 15, and a lower end portion 33*c* is formed so that the lower end portion 33*c* faces to the inside of the space portion 16.

With this structure, as shown by an arrow in FIG. 7, lubricating oil O, which is atomized and adheres to the inner surface 3*f* of the cover member 3 by the drive of the variable valve system, moves on and along the inner surface 3*f* and comes into the oil passage groove 33 from the upper end portion 33*a* by its own weight. While a part of the lubricating oil is being lubricating the ball bearing 15, it flows inside the space portion 16. Further, the lubricating oil adheres to the whole of the front end surface side of the housing 10, then the housing 10 is effectively cooled down.

Accordingly, in this embodiment, as the lubricating oil supplying mechanism supplying the lubricating oil to the space portion 16, since only the oil passage groove 33 is provided on the inner surface of the cover member 3 by the cutting-away, its manufacturing becomes extremely easy. It is therefore possible to increase in productivity and also to reduce in cost.

Sixth Embodiment

Figure 8:
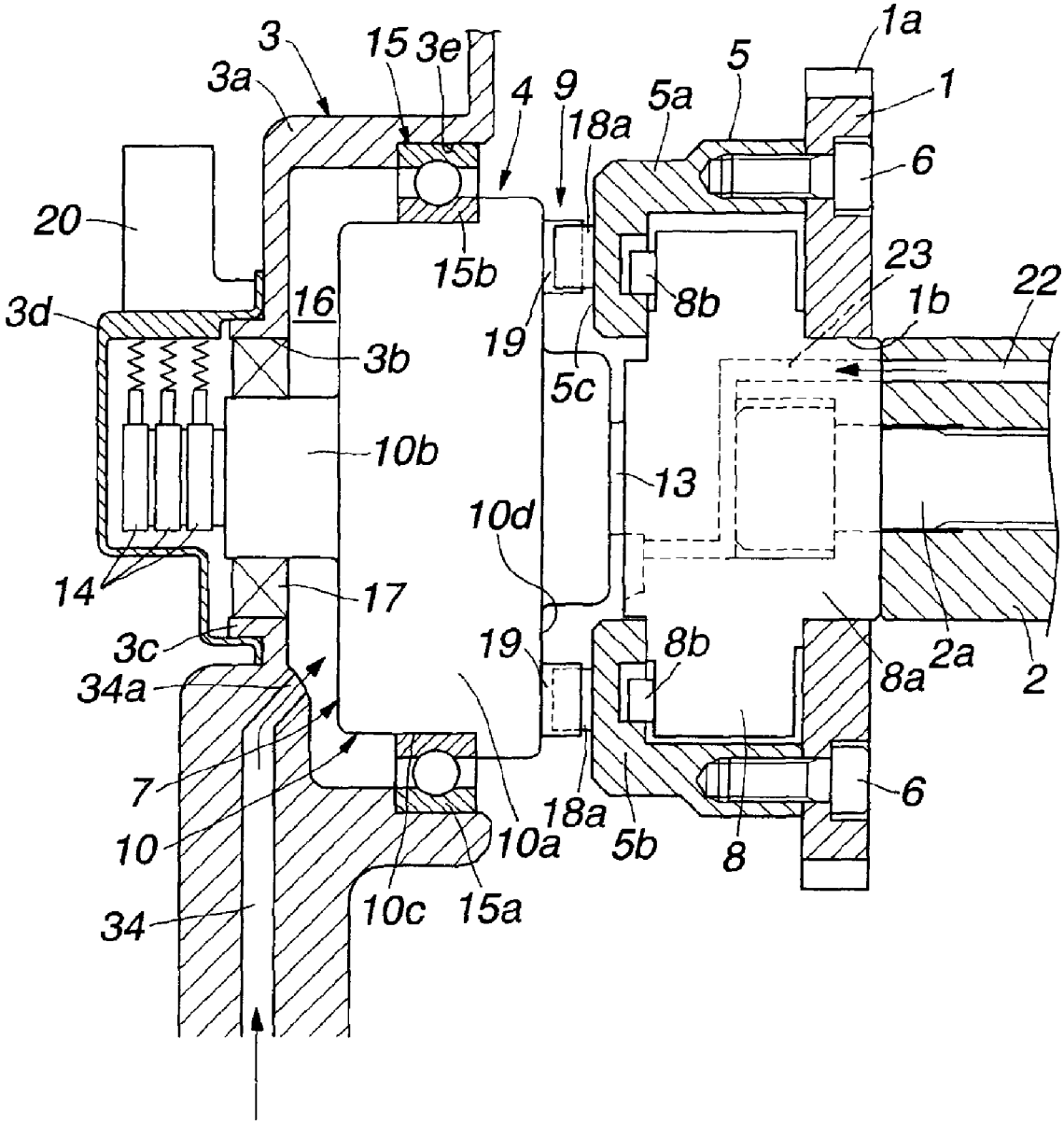
FIG. 8 is a longitudinal cross section of a variable valve timing control apparatus according to a sixth embodiment.

FIG. 8 shows a sixth embodiment. Also in this embodiment, the lubricating oil supplying mechanism is further changed. Although the oil supply hole 22 and the oil passage 23 remain as they are, a lower portion of the swelling part 3*a* of the cover member 3 is formed thick, and another oil supply passage 34 is formed inside the lower portion.

Regarding this oil supply passage 34, its downstream end side is connected to the main oil gallery 28, and its upstream end side is bent and inclines and further is provided with an opening portion 34*a*. This opening portion 34*a* is formed so that the opening portion 34*a* points to the front end surface of the housing body 10*a* and faces to a lower side of the space portion 16.

Consequently, as shown by arrows in FIG. 8, the lubricating oil pumped out to the oil supply passage 34 from the oil pump 27 through the main oil gallery 28 is jetted toward the inside of the space portion 16, and is directly jetted to the inner peripheral side or the outer peripheral side of the front end surface of the housing body 10*a*. Therefore, the space portion 16 is provided with plenty of lubricating oil, and the front end surface of the housing body 10*a* is forcibly cooled down. In particular, since the plenty of lubricating oil in the space portion 16 is violently stirred or scattered by the rotational centrifugal force of the housing 10, the cool-down effect of the electric motor 7 is even further improved, and lubricity of the ball bearing 15 is also improved.

Here, as described above, the lubricating oil supplied to the coupling mechanism 9 side from the oil supply hole 22 via the oil passage 23 is stirred or scattered by the fitting pieces 18*a*, 18*b* and the fitting protrusions 19, and the rear end surface 10*d* side of the housing body 10*a* is adequately cooled down.

Seventh Embodiment

Figure 9:
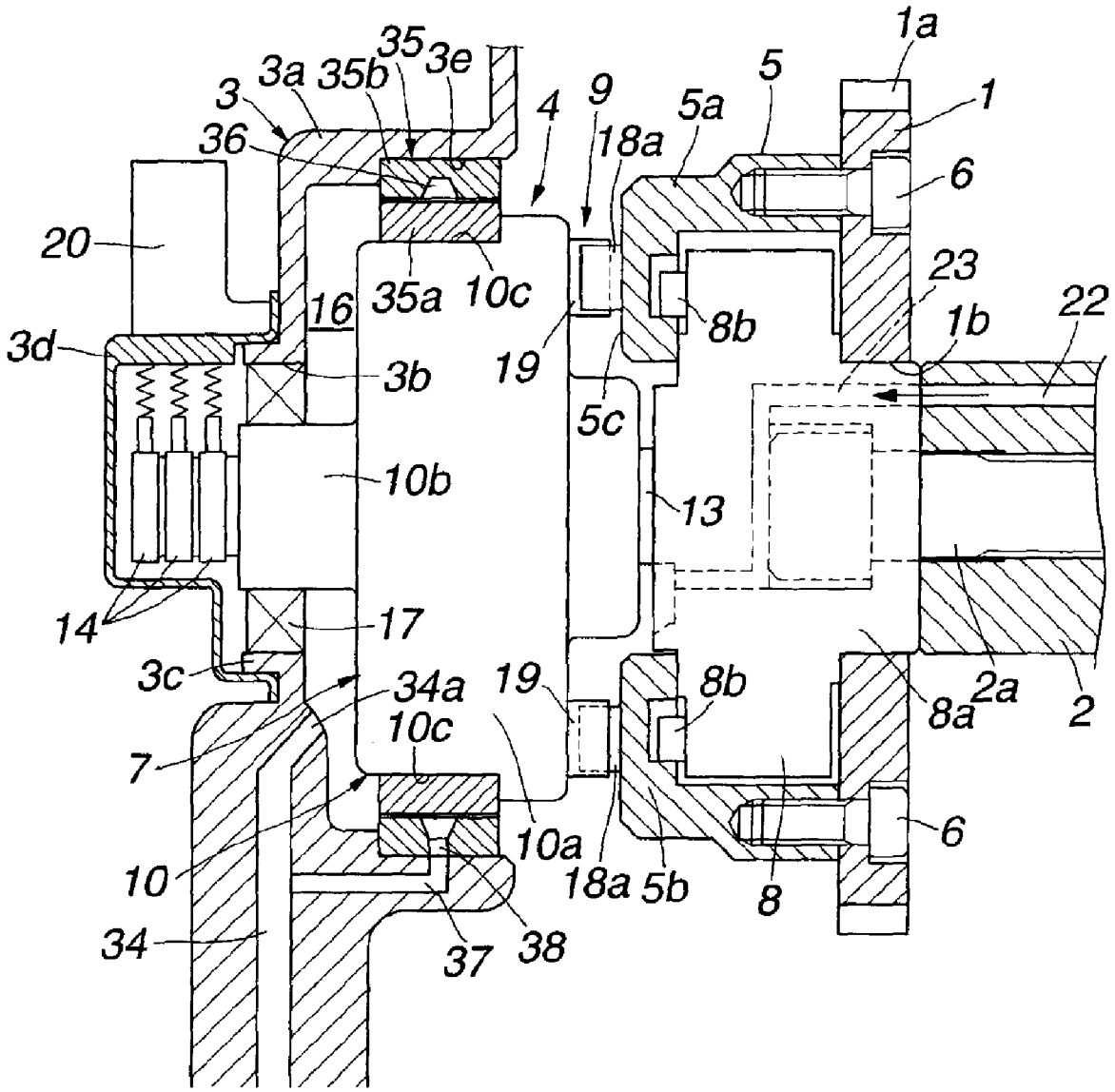
FIG. 9 is a longitudinal cross section of a variable valve timing control apparatus according to a seventh embodiment.

FIG. 9 shows a seventh embodiment. Instead of the ball bearing, a plain bearing 35 is used as the bearing member. In addition, as the structure of the lubricating oil supplying mechanism, this embodiment is based on the oil supply passage 34 of the sixth embodiment, and further this mechanism is configured to supply the lubricating oil also to an inside of the plain bearing 35.

That is, the plain bearing 35 is formed by two inner and outer circumferential side annular rings 35*a*, 35*b* which are separated from each other as inner and outer double rings. These inner and outer circumferential side annular rings 35*a*, 35*b* are set to be able to slide each other. An inner circumferential portion of the inner circumferential side annular ring 35*a* is fitted and fixed to the stepped recessed fitting groove 10*c* of the housing body 10, then positioning of the plain bearing 35 in one direction of the axial direction is made. On the other hand, an outer circumferential portion of the outer circumferential side annular ring 35*b* is fitted and fixed to the stepped recessed fitting groove 3*e* of the swelling part 3*a*, then positioning of the plain bearing 35 in the other direction of the axial direction is made.

As can be seen in FIG. 9, a substantially trapezoidal cross-section annular passage 36 is formed on an inner circumferential surface of the outer circumferential side annular ring 35*b* at a middle position of the axial direction. Furthermore, a branch path 37 is provided in the lower portion of the cover member 3, and its one end communicates with the oil supply passage 34 formed inside the lower portion, namely, that the branch path 37 branches off at a midpoint of the oil supply passage 34. The annular passage 36 communicates with the branch path 37 through a radius or radial direction hole 38.

Consequently, according to this embodiment, same as the sixth embodiment, by the lubricating oil forcibly supplied to the space portion 16 etc. from the oil supply passage 34, the effective cooling-down of the housing body 10*a* is performed. Also a sliding surface between the inner and outer circumferential side annular rings 35*a*, 35*b* is adequately lubricated by the lubricating oil flowing into the annular passage 36 via the branch path 37.

Furthermore, although the heat generated in the electric motor 7 is conveyed to the housing body 10*a* and further conveyed to the both annular rings 35*a*, 35*b* from this housing body 10*a*, since heat exchange is performed by the annular rings 35*a*, 35*b* and the lubricating oil circulating in the annular passage 36, cool-down efficiency of the housing 10 is improved. In particular, because a sliding contact area between the both annular rings 35*a*, 35*b* is large as compared with the ball bearing, heat transfer from the housing body 10*a* becomes high, the cool-down efficiency of the housing 10 is thus further improved.

The present invention is not limited to the above explained embodiments. For instance, as the lubricating oil supplying mechanism, other structures could be employed. In addition, as the electric motor, a brushless DC motor could be used.

Moreover, as the bearing member, instead of the ball bearing, a needle bearing could be used. When using the needle bearing, an advantage, such as size reduction in the radial direction, of the system, can be obtained.

The entire contents of Japanese Patent Application No. 2008-150017 filed on Jun. 9, 2008 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member adapted to be driven in synchronization with rotation of an engine crankshaft;

a driven rotary member which rotates and actuates an engine valve by a turning force transmitted from the drive rotary member;

an electric motor which rotates with the drive rotary member and changes a rotational phase of the driven rotary member relative to the drive rotary member through a current application to a coil;

a cover member which covers the electric motor with a clearance interposed therebetween;

a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member; and a lubricating oil supplying mechanism which supplies lubricating oil to the space portion.

2. The variable valve timing control apparatus of the internal combustion engine as claimed in claim 1, further comprising:

a slip ring that makes sliding contact with a brush of the electric motor for supplying the current to the coil from outside; and a seal member for sealing a gap between the space portion and a slip ring side.

3. The variable valve timing control apparatus of the internal combustion engine as claimed in claim 2, wherein:

the electric motor is a brush DC motor.

4. The variable valve timing control apparatus of the internal combustion engine as claimed in claim 1, wherein:

the lubricating oil supplying mechanism supplies the lubricating oil to an inside of the space portion from a more inward side than an installation position of the bearing member.

5. The variable valve timing control apparatus of the internal combustion engine as claimed in claim 4, wherein:

the lubricating oil supplying mechanism has an oil passage hole that is formed inside a rotation shaft of the electric motor for supplying the lubricating oil to the inside of the space portion.

6. The variable valve timing control apparatus of the internal combustion engine as claimed in claim 1, wherein:

the bearing member is at least one of a ball bearing or a needle bearing.

7. The variable valve timing control apparatus of the internal combustion engine as claimed in claim 1, wherein:

the lubricating oil supplying mechanism has (a) an oil receiving portion that is provided on an electric motor side for receiving the lubricating oil coming from a driven rotary member side; and (b) an oil passage that is formed at the electric motor for supplying the lubricating oil collected at the oil receiving portion to the inside of the space portion.

8. The variable valve timing control apparatus of the internal combustion engine as claimed in claim 1, further comprising:

a coupling mechanism provided on one side of the electric motor, which is an opposite side to the space portion, for transmitting the turning force from the drive rotary member to the electric motor.

9. The variable valve timing control apparatus of the internal combustion engine as claimed in claim 8, wherein:

the coupling mechanism has the following protruding portions;

(a) protrusions provided on an end surface of the electric motor, which is the opposite side to the space portion; and (b) protruding pieces provided on an end surface of the drive rotary member, which faces to the end surface of the electric motor, and the protrusions and the protruding pieces protrude from the respective end surfaces toward the opposing surfaces.

10. The variable valve timing control apparatus of the internal combustion engine as claimed in claim 9, wherein:

the protruding portions are radially arranged on the respective end surfaces.

11. The variable valve timing control apparatus of the internal combustion engine as claimed in claim 10, wherein:

each of the protruding pieces has an outer side surface that inclines to a delay side with respect to a normal in a rotation direction.

12. The variable valve timing control apparatus of the internal combustion engine as claimed in claim 8, wherein:

the coupling mechanism has a structure in which each of a drive rotary member side and an electric motor side of the coupling mechanism is able to shift in a radial direction.

13. The variable valve timing control apparatus of the internal combustion engine as claimed in claim 8, wherein:

the lubricating oil supplying mechanism has a structure in which the lubricating oil flows through an inner circumferential side of the coupling mechanism and is supplied to the space portion.

14. The variable valve timing control apparatus of the internal combustion engine as claimed in claim 13, further comprising:

a speed reduction mechanism that transmits a turning force of a rotation shaft of the electric motor to the driven rotary member.

15. The variable valve timing control apparatus of the internal combustion engine as claimed in claim 14, wherein:

the drive rotary member has a substantially cylindrical rotation transmission member that accommodates the speed reduction mechanism, and the lubricating oil supplying mechanism has a lubricating oil passage formed inside the speed reduction mechanism, one end of the lubricating oil passage is connected to an oil pump side and the other end communicates with an inside of the rotation shaft of the electric motor or communicates with the inner circumferential side of the coupling mechanism.

16. A variable valve timing control apparatus of an internal combustion engine, comprising:

a drive rotary member adapted to be driven in synchronization with rotation of an engine crankshaft;

a driven rotary member which rotates and actuates an engine valve by a turning force transmitted from the drive rotary member;

an electric motor which rotates with the drive rotary member and changes a rotational phase of the driven rotary member relative to the drive rotary member through a current application to a coil;

a cover member which covers the electric motor with a clearance interposed therebetween;

a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member; and a communication passage which is formed on an inner surface of the cover member and connects an inside of the cover member and the space portion while straddling the bearing member, and by which lubricating oil that adheres to the inner surface of the cover member passes through the bearing member and is supplied to the space portion.

17. The variable valve timing control apparatus of the internal combustion engine as claimed in claim 16, wherein:

the communication passage has a continuous surface that continues from an upper portion of the cover member to the space portion, and the upper portion of the cover member is positioned in a higher position than the bearing member in the gravity direction.

18. The variable valve timing control apparatus of the internal combustion engine as claimed in claim 16, wherein:

the communication passage is formed so that the lubricating oil runs down the inner surface of the cover member and trickles down to the space portion.

19. A variable valve timing control apparatus of an internal combustion engine, comprising:

a drive rotary member adapted to be driven in synchronization with rotation of an engine crankshaft;

a driven rotary member which rotates and actuates an engine valve by a turning force transmitted from the drive rotary member;

an electric motor which rotates with the drive rotary member and changes a rotational phase of the driven rotary member relative to the drive rotary member through a current application to a coil;

a cover member which covers the electric motor with a clearance interposed therebetween;

a bearing member which is installed between an outer periphery of the electric motor and an inner periphery of the cover member and defines a space portion between an end surface, in a rotation shaft direction, of the electric motor and an opposing inner end surface of the cover member, the bearing member rotatably supporting the electric motor with respect to the cover member, and lubricating oil being supplied to the space portion from an inner circumferential side, which is a rotation shaft side of the electric motor, toward an outer circumferential side.

20. The variable valve timing control apparatus of the internal combustion engine as claimed in claim 19, wherein:

the lubricating oil is supplied to an inner circumferential side of the space portion from a cover member side, and further is supplied toward an outer circumferential side of the space portion by a rotational centrifugal force of the electric motor rotating with the drive rotary member.

21. The variable valve timing control apparatus of the internal combustion engine as claimed in claim 19, wherein:

the lubricating oil is supplied to an inner circumferential side of the space portion from an inside of the rotation shaft of the electric motor, and further flows toward an outer circumferential side of the space portion by rotation of the electric motor together with the drive rotary member.

22. The variable valve timing control apparatus of the internal combustion engine as claimed in claim 19, wherein:

the bearing member is a plain bearing, and the plain bearing has, inside thereof, an annular passage where the lubricating oil flows.

* * * * *